US005660324A

United States Patent [19]

Rowland

[11] Patent Number: 5,660,324

[45] Date of Patent: Aug. 26, 1997

[54] DISPENSING CARTON WITH INTEGRAL POUR SPOUT

[75] Inventor: Angela L. Rowland, Trappe, Pa.

[73] Assignee: Jefferson Smurfit Corporation, Clayton, Mo.

[21] Appl. No.: 672,115

[22] Filed: Jun. 27, 1996

[51] Int. Cl.[6] ..... B65D 17/32

[52] U.S. Cl. ..... 229/215; 229/160.2

[58] Field of Search ..... 229/210, 215, 229/221, 160.2

[56] References Cited

U.S. PATENT DOCUMENTS

| | | | |
|---|---|---|---|
| 3,184,137 | 5/1965 | Mohler | 229/215 |
| 3,484,034 | 12/1969 | Sternau | 229/160.2 X |
| 4,194,677 | 3/1980 | Wyosocki | 229/215 |
| 5,215,250 | 6/1993 | Roccaforte | 229/221 X |
| 5,238,181 | 8/1993 | Mahler | 229/215 |
| 5,372,301 | 12/1994 | Besson | 229/215 |
| 5,445,316 | 8/1995 | Roccaforte | 229/215 |
| 5,531,376 | 7/1996 | Brink et al. | 229/221 |

FOREIGN PATENT DOCUMENTS

| | | | |
|---|---|---|---|
| 4308047 | 12/1993 | Germany | 229/215 |

*Primary Examiner*—Allan N. Shoap
*Assistant Examiner*—Christopher J. McDonald
*Attorney, Agent, or Firm*—Richard W. Carpenter

[57] ABSTRACT

A one piece, paperboard, dispensing carton having a dispensing opening in a side wall panel thereof, the major portion of which is covered by a cover panel foldably and partially detachably joined to the side wall panel, and also having a pour spout, secured to the cover panel and joined to a side edge of a glue flap panel by a two-piece connecting member that includes a pair of upper and lower connecting elements, one of which is adapted to cover a remaining portion of the dispensing opening.

20 Claims, 4 Drawing Sheets

DISPENSING CARTON WITH INTEGRAL POUR SPOUT

BACKGROUND OF THE INVENTION

1. Field of the Invention

This invention relates to paperboard dispensing cartons of the type generally used for the packaging of granular products, and more particularly to cartons having integral pour spouts.

2. Description of the Background Art

A background art search directed to the subject matter of this invention conducted in the United States Patent and Trademark Office disclosed the following U.S. Pat. Nos.:

| | | | |
|---|---|---|---|
| 1,907,939 | 2,332,205 | 2,444,104 | 2,610,770 |
| 2,701,679 | 3,184,137 | 3,344,972 | 3,362,612 |
| 3,484,034 | 3,570,743 | 4,111,351 | 4,192,440 |
| 4,194,677 | 4,569,443 | 4,953,781 | 5,014,888 |
| 5,238,181 | 5,316,212 | 5,372,301 | CA 586,884 |
| NO 92,486 | | | |

None of the patents uncovered in the search discloses a one piece, paperboard, dispensing carton having a dispensing opening in a side wall panel thereof, the major portion of which is covered by a cover panel foldably and detachably joined to the side wall panel, and an integral pour spout having a central panel adhesively secured to the cover panel and being joined to a side edge of a glue flap panel by a connecting member that includes a pair of upper and lower connecting elements, one of which is adapted to cover a remaining portion of the dispensing opening and wherein the pour spout includes means for preventing it from being pulled out of the carton, means for maintaining it in an open position, and means for preventing it from being pushed too far into the carton.

SUMMARY OF THE INVENTION

It is a primary object of the invention to provide a unique paperboard dispensing carton including an integral pour spout that is joined to a carton glue flap by a novel connecting member.

Another object of the invention is the provision of a dispensing carton wherein the pour spout includes means for preventing the spout from being pulled too far out of the carton, means for maintaining the pour spout in an open position, and means for preventing the spout from being pushed too far into the carton.

A more specific object of the invention is to provide a carton of the type described wherein the carton pour spout connecting member comprises a pair of upper and lower connecting elements, one of which covers a portion of a dispensing opening.

These and other objects of the invention will be apparent from an examination of the following description and drawings.

It will be understood that, for purposes of clarity, certain elements may have been omitted from certain views where they are believed to be illustrated to better advantage in other views.

DESCRIPTION OF THE PREFERRED EMBODIMENT

Figure 1:
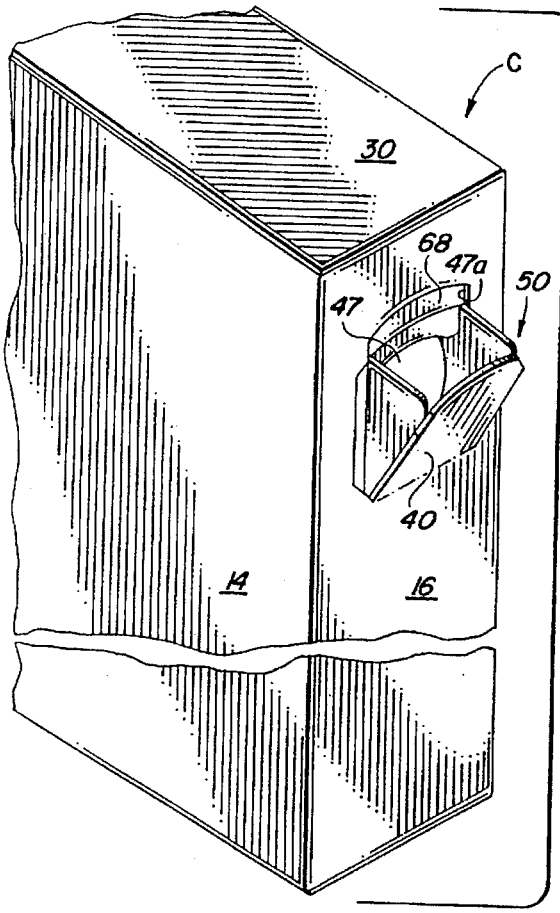
FIG. 1 is an isometric view of a portion of a dispensing carton with a pour spout arrangement embodying the invention.
Figure 2:
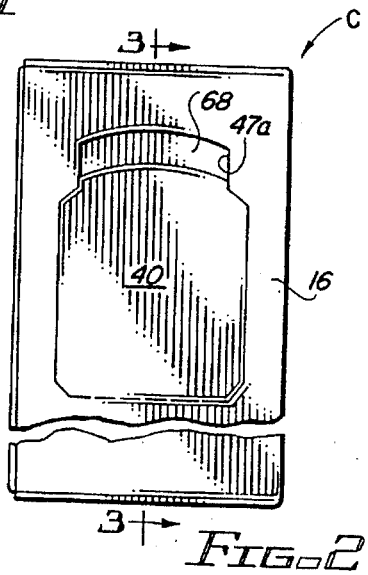
FIG. 2 is an end elevational view of a portion of the structure illustrated in FIG. 1.
Figure 3:
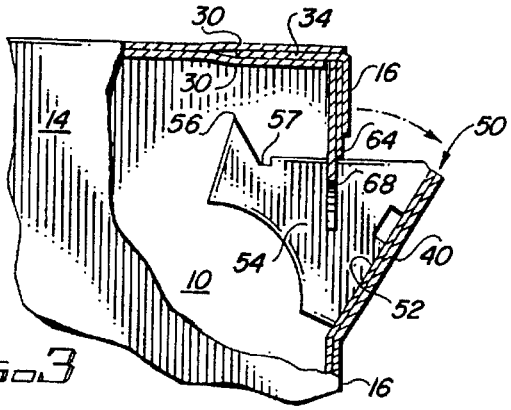
FIG. 3 is a sectional view taken on line 3—3 of FIG. 2
Figure 4:
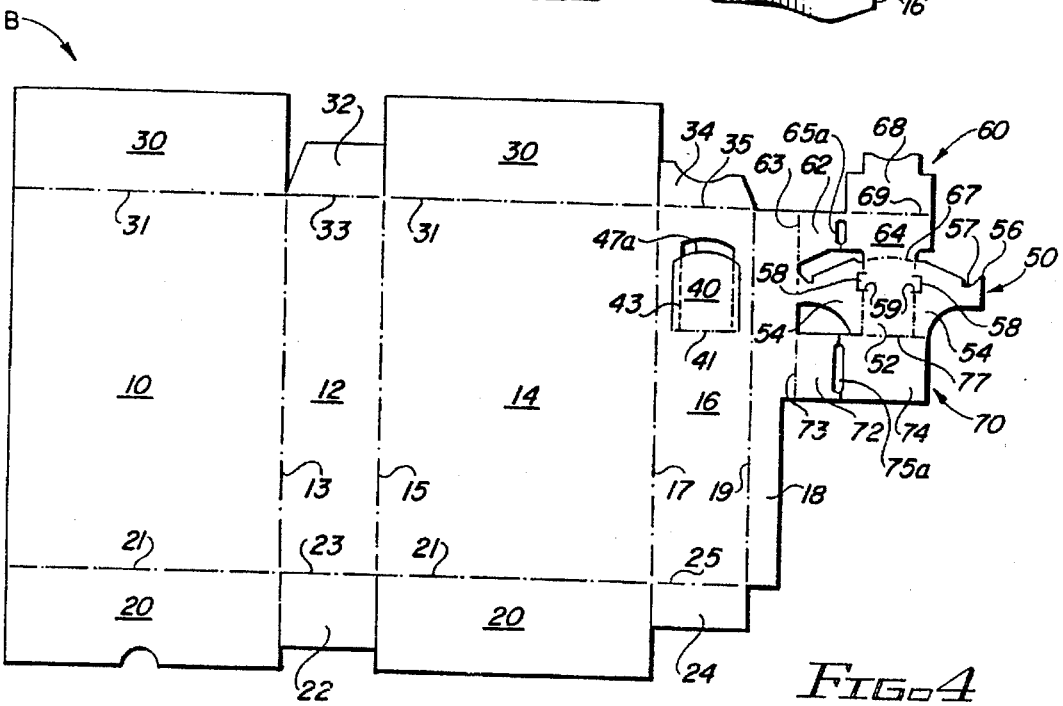
FIG. 4 is a top plan view of a blank of sheet material from which the carton illustrated in previous views may be formed.
Figure 4A:
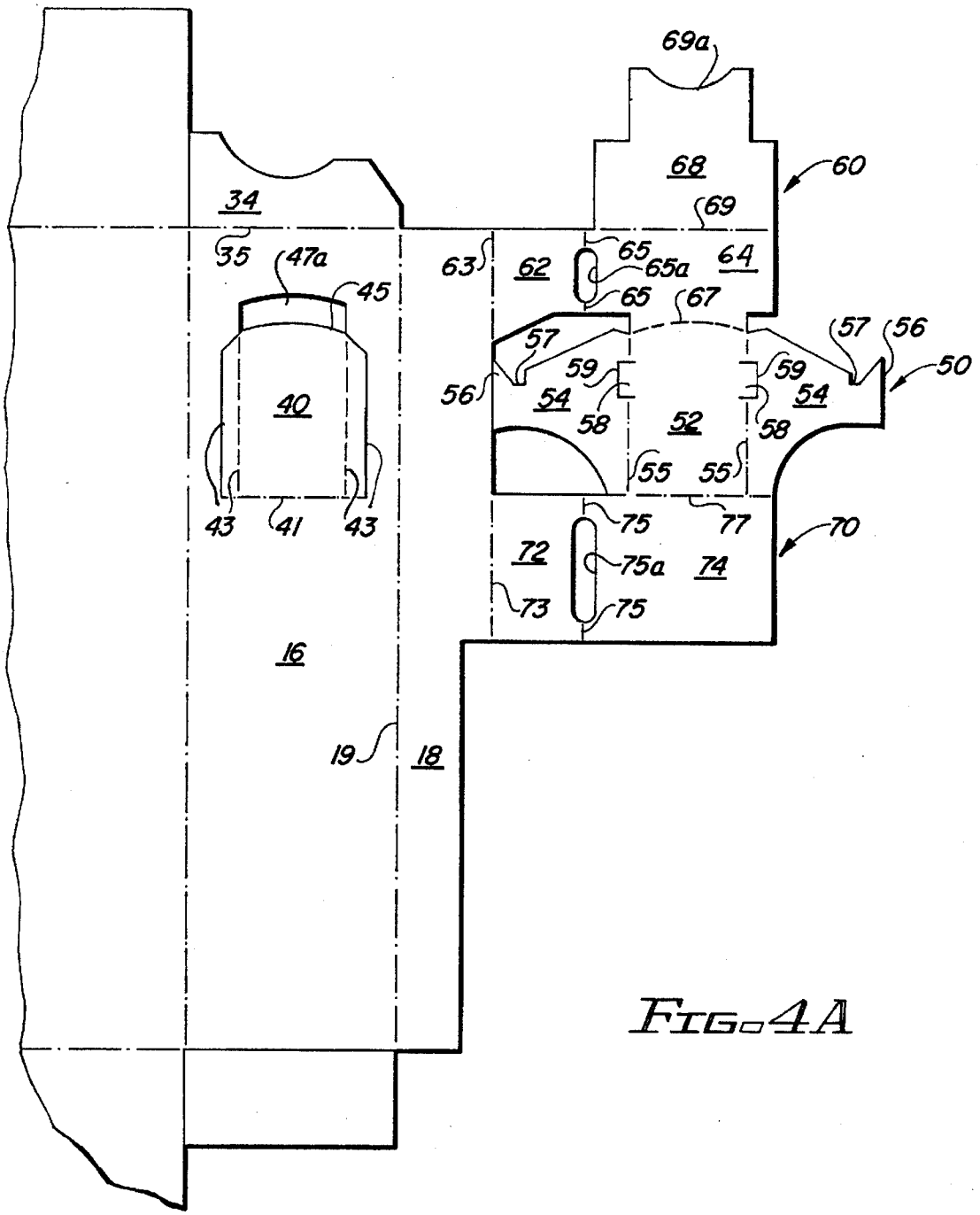
FIG. 4A is an enlarged view of a portion of the structure illustrated in FIG. 4.
Figure 5:
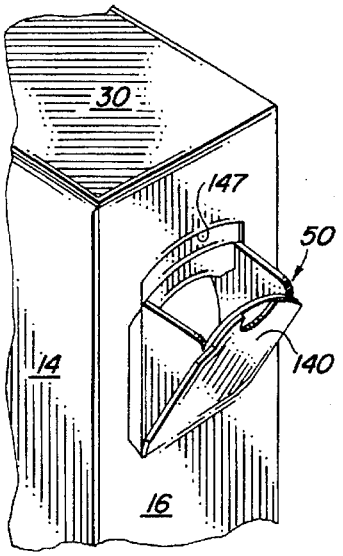
FIGS. 5–8 are views similar to those of FIGS. 1–4, but illustrate a modified form of the invention.

Referring now to the drawings for a better understanding of the invention, it will be seen that the dispensing carton embodying features of the invention, and indicated generally at C in FIGS. 1–3, may be formed from the unitary blank B of foldable sheet material, such as paperboard, illustrated in FIGS. 4 and 4A.

As best seen in FIG. 4, carton C has a main or body portion that includes a first major side wall panel 10, a first minor side wall panel 12, a second major side wall panel 14, a second minor side wall panel 16, and a glue flap 18 that are foldably joined to each other, along parallel fold lines 13, 15, 17, and 19, to form a tubular structure open at the upper and lower ends.

The lower end of the carton may be closed by a pair of major lower closure flaps 20 and a pair of minor lower closure flaps 22, foldably joined to the lower ends of the major and minor side wall panels along fold lines 21 and 23, respectively, and secured to each other in overlapped relation.

The upper end of the carton may be closed by a pair of major upper closure flaps 30 and a pair of minor upper closure flaps 32, foldably joined to the upper ends of the major and minor side wall panels along fold lines 31 and 33, respectively, and secured to each other in overlapped relation.

Second minor side wall panel 16 is provided with a dispensing opening 47, located a relatively short distance below the upper end of the panel. The major portion of opening 47 is initially covered by an integral pull tab or cover panel 40 defined by a lower horizontal fold line 41, hinging the cover panel to the side wall panel, by a pair of vertical weakened lines of tear 43 extending upwardly from opposite ends of fold line 41, and by a free upper edge 44 that is spaced from the upper edge of opening 47.

Thus, panel 40 covers the major portion of opening 47, the remaining portion **47*a*** being covered by a section of a pour spout connecting member element, as hereinafter described.

In order to prevent sifting of material from the carton, the weakened lines of tear 43 are preferably each formed by a pair of laterally spaced partial cuts made from both the inside and outside of the carton side wall.

Spaced a relatively short distance below the upper edge 44 of panel 40 is a fold line 45, which defines with the upper edge a relatively narrow strip of material that is adapted to be deflected outwardly to help one grasp the cover panel 40 and attached pour spout central panel 52 and pull the spout out of the carton with the end of a finger.

As seen in FIGS. 4 and **4*a*, the pour spout structure includes a pour spout 50 and a connecting member comprising upper and lower elements 60 and 70, joining the spout 50 to the carton glue flap 18**.

Again referring to FIG. 4A, it will be seen that the pour spout, indicated generally at 50, includes a main or central panel 52 which is flanked by a pair of wings or side panels 54, foldably joined along fold lines 55 to opposite side edges thereof.

At their outer ends, side panels 54 are provided with upwardly projecting hook portions 56 that are adapted to engage the carton side wall panel and connecting member third section to prevent the pour spout from being pulled too far out of the carton.

Immediately inwardly adjacent hook portions 54, the side panel upper edges have recesses 57 that are adapted to engage the carton side wall panel and upper connecting element third section to temporarily maintain the pour spout in an open position.

In order to prevent the pour spout 50 from being pushed too far into the carton, pour spout main panel 52 is provided with a pair of ears 58, defined by cut lines 59, that extend laterally outward from opposite sides of the main panel for engagement with the carton side wall panel.

As best seen in FIG. 4A, pour spout 50 is connected to the glue flap 18 by a connecting member that includes a pair of upper and lower connecting elements 60 and 70, respectively.

Upper connecting element 60 includes a first section 62, foldably joined at one side edge along a fold line 63 to a side edge of glue flap 18; a second section 64, foldably joined at one side edge on a fold line 65 to an opposite side edge of first section 62, and detachably joined at a lower edge along a weakened line of tear 67 to an upper edge of pour spout central panel 52; and a third section 68, foldably joined at an upper edge along a fold line 69 to an upper edge of second section 64.

Lower connecting element 70 includes a first section 72, foldably joined at one side edge along a fold line 73 to a side edge of glue flap 18, and a second section 74, foldably joined at one side edge on a fold line 75 to an opposite side edge of first section 72, and detachably joined at an upper edge along a fold line 77 to a lower edge of pour spout central panel 52.

Openings 65*a* and 75*a* may be provided to relieve stress at fold lines 65 and 75.

In order to form the carton C from the paperboard blank B, the upper and lower connecting elements 60 and 70, together with the attached pour spout 50, are folded over 180 degrees with the connecting element first sections 62 and 72 overlying the carton glue flap 18, with the connecting element second sections 64 and 74 and the pour spout central panel 52 overlying the carton minor side wall panel 16, with the connecting element second sections adhesively secured to the inner surface of side wall panel, and the pour spout central panel 52 adhesively secured to the inner surface of dispensing opening cover panel 40.

Upper connecting element third section 68 is then folded 180 degrees to overlie second section 64, to which it is adhesively secured, and also a portion of panel 40. Both of the connecting element sections overlie and cover the upper portion 47*a* of the dispensing opening 47 that is located above the upper edge of cover panel 30.

At this point the carton panels may be folded in a conventional manner, with the glue flap 18 adhesively secured to the remote major side wall panel 10, to form a collapsed tubular structure open at opposite ends.

After the carton lower end has been closed and the carton filled by a packer, the upper end closure flaps may be folded over into overlapped relation and secured to each other to close the upper end of the carton. Preferably, the minor upper closure flaps 32 are sandwiched between the major upper closure flaps 30.

In order to dispense material from the carton, a finger may be inserted just above the cover panel 40, and the cover panel and attached pour spout central panel 52 pulled out of the carton to form a pour spout 50. Deflection of cover panel upper marginal portion 46 facilitates opening the pour spout.

As previously mentioned hooks 56 prevent the pour spout 50, from being pulled too far out of the carton; recesses 57 help hold the pour spout in an open position; and ears 58 prevent the pour spout from being pushed too far into the carton.

In FIGS. 5–14 slightly modified forms of the invention are illustrated. In each of these embodiments the structures of the carton side walls, end closure flaps, pour spouts and connecting member elements are substantially the same as were described in detail in connection with the first embodiment illustrated in FIGS. 1–4A. Accordingly, the same numerals have been used to describe those structures.

The difference between the original embodiment and the subsequent embodiments resides solely in the design and structure of the side wall panel dispensing opening and cover panel, where related numerals have been used to identify the structures.

Turning now to FIGS. 5–8, it will be seen that the upper portion of dispensing opening 147 is covered by a lower portion of upper connecting element second section 64 and an lower portion of upper connecting member third section 68. This is true for each of the embodiments of the invention described herein.

Figure 6:
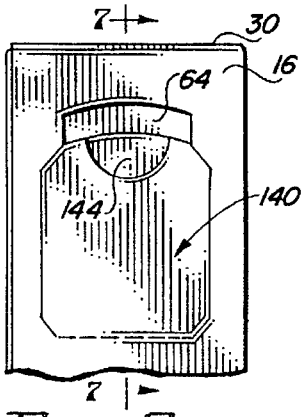
Figure 7:
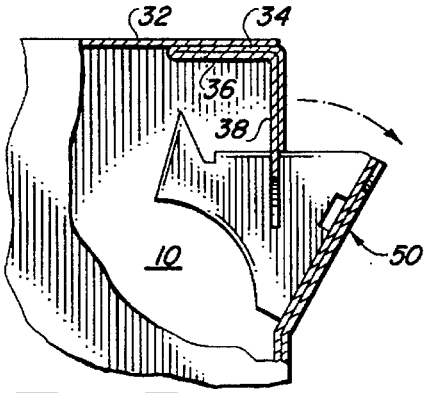
Figure 8:
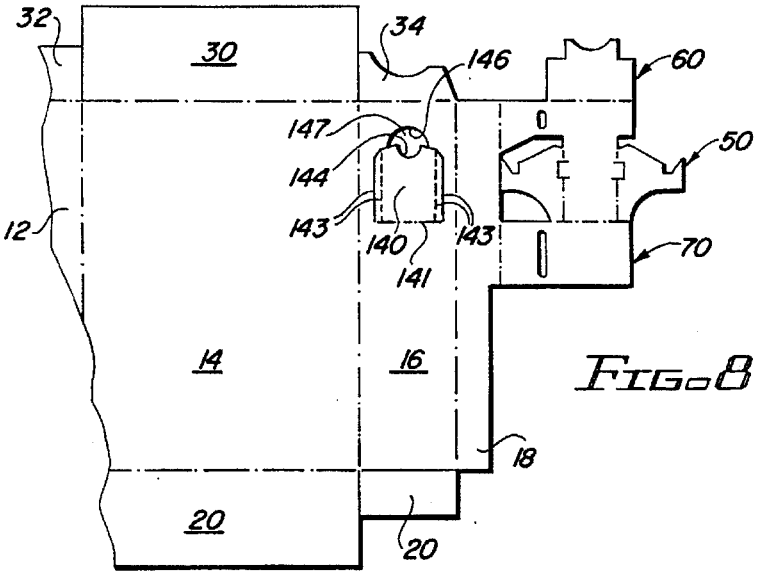

As best seen in FIG. 6, the upper edge 146 of dispensing opening 147 is concave and semi-circular, as is the majority of the upper edge 144 of cover panel 140. Thus, a generally round opening is presented for insertion of a finger tip to grasp the upper edge of the attached cover panel and pour spout central panel to detach the cover panel from the side wall panel 16 and pull the pour spout part way out of the carton.

Figure 9:
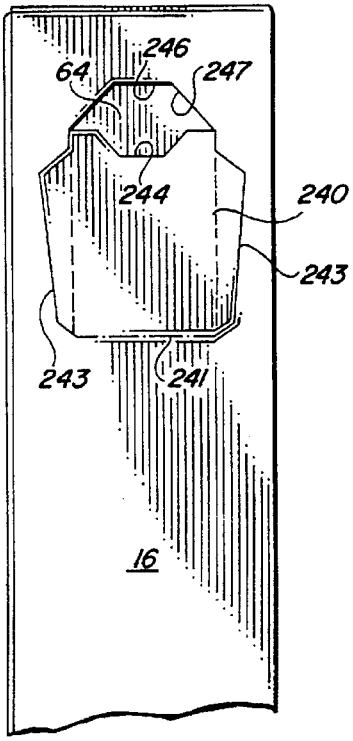
FIGS. 9 and 10 are views similar to those of FIGS. 2 and 4, but illustrate another modified form of the invention.
Figure 10:
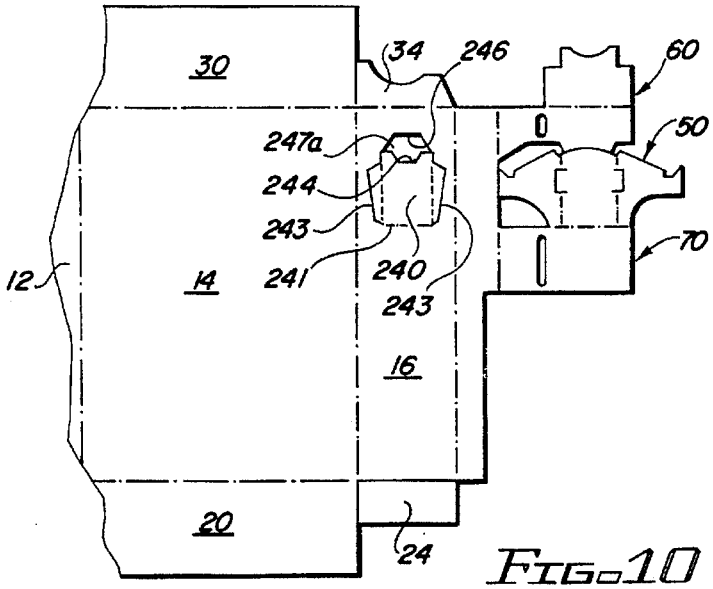

In the embodiment of FIGS. 9 and 10 the upper edge 246 of dispensing opening 247 and the upper edge 246 of cover panel 240 are also concave, but formed with straight lines rather than arcs. Also, in this embodiment the cover panel 240 is generally key stone-shaped, with cut lines side edge 243 which diverge upwardly from the ends of fold line 241.

Figure 11:
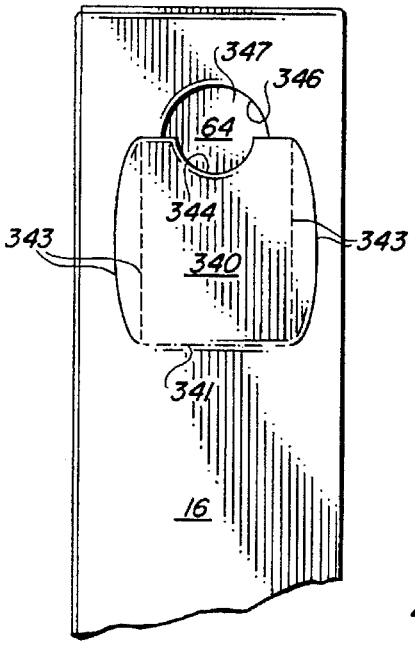
FIGS. 11 and 12 are views similar to those of FIGS. 2 and 4, but illustrate another modified form of the invention.
Figure 12:
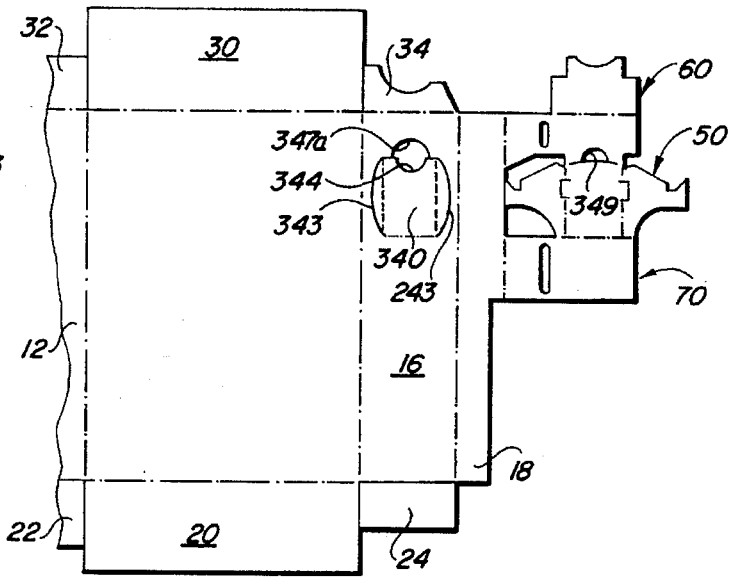
Figure 13:
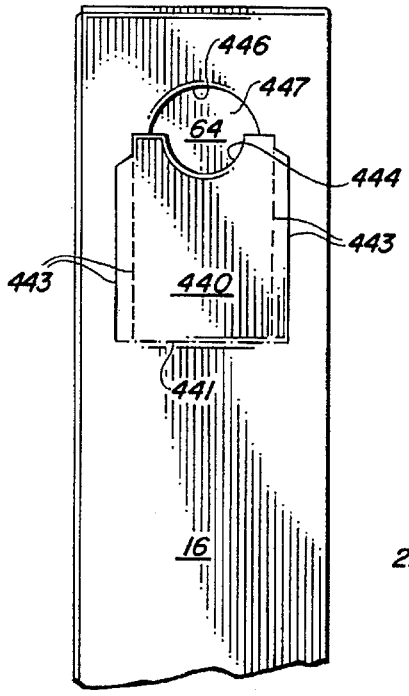
FIGS. 13 and 14 are views similar to those of FIGS. 2 and 4, but illustrate another modified form of the invention.
Figure 14:
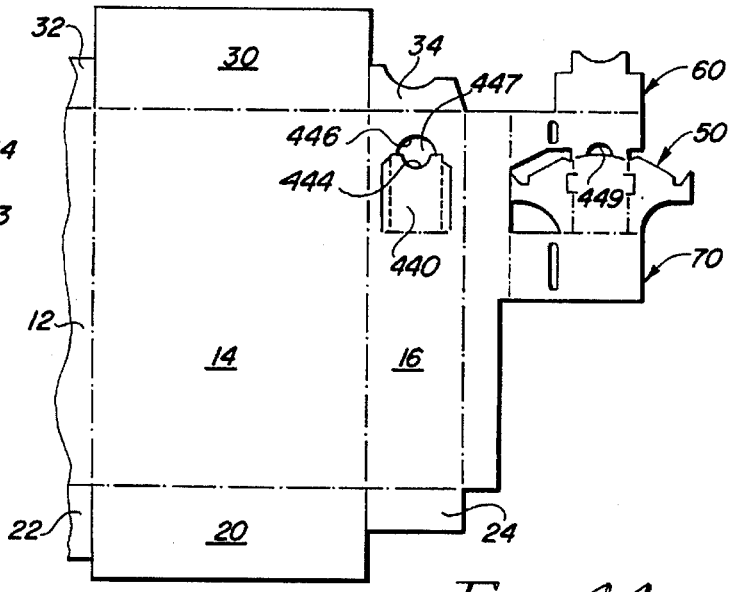

In the embodiment of FIGS. 11 and 12, and also that of FIGS. 13 and 14, the line of weakness 67 between the lower edge of upper connecting element second section 64 and the upper edge of the related cover panel 340 or 440 is interrupted by an arcuate cut that forms a recess 349 or 449 in the upper connecting element second section. The purpose of this is to facilitate opening the barton, because it permits the insertion of a finger to grasp more easily the upper edge of the pour spout central panel, which is secured to the rear surface of the cover panel.

The difference between the embodiment of FIGS. 11 and 12 and that of FIGS. 13 and 14 is that in the former embodiment the inner set of cover panel side edge cut lines 343 are bowed outwardly; whereas, in the latter embodiment the cover panel side edge cut lines 443 are generally parallel to each other.

Thus it should be understood and appreciated that, in each of the various forms illustrated and described herein, the invention provides a unique pour spout arrangement for a one-piece paperboard carton, wherein the pour spout as attached to a carton glue flap by a novel two-piece connecting member comprising a pair of upper and lower elements that join the pour spout to the body of the carton, but also cooperate with the pour spout and dispensing opening cover panel to provide a reasonably sift-resistant dispensing arrangement that is easy to open, will stay in position when open, and includes means for preventing the pour spout from being accidentally pushed too far into the carton.

What is claimed is:

1. A dispensing carton with an integral pour spout, said carton being formed from a unitary blank of foldable sheet material, such as paperboard, and comprising:

(a) a first major side wall panel, a first minor side wall panel, a second major side wall panel, a second minor side wall panel, and a glue panel foldably joined to each other along parallel fold lines to form a tubular structure open at each end;

(b) pairs of major and minor upper and lower closure flaps foldably joined to upper and lower end edges of said major and minor side wall panels, respectively, and secured to each other in overlapped relation, with said minor upper closure flaps interposed between said major closure flaps, to close said carton ends;

(c) one of said minor side wall panels located adjacent said glue panel and having formed in an upper area thereof, but spaced below an upper edge thereof, a dispensing opening, a major portion of which is covered by a cover panel that is formed from material of said one minor side wall panel, that has a lower edge foldably joined to said one minor side wall panel along a fold line, that has opposed side edges detachably joined to said one minor side wall panel by a pair of weakened lines of tear extending upwardly from opposite ends of said fold line, and that has a free upper edge spaced downwardly from an upper edge of said dispensing opening;

(d) a pour spout including a central panel and a pair of side panels foldably joined to opposite side edges of said side central panel and having hooks at outer ends thereof;

(e) a connecting member upper element including:

(i) a first section having an inner side edge foldably joined to a free side edge of said glue panel, lying against said glue panel, and extending toward said one minor side wall panel;

(ii) a second section having a side edge foldably joined to another side edge of said first section, being secured to said one minor side wall panel, having a lower portion covering a minor portion of said opening, and having a lower edge detachably joined to an upper edge of said pour spout central panel;

(iii) a third section having an upper edge foldably joined to an upper edge of said second section, being folded downwardly over and adhesively secured to said second section, and having a lower portion extending downwardly over an upper portion of said cover panel;

(f) a connecting member lower element including:

(i) a first section having an inner side edge foldably joined to a free side edge of said glue panel and extending outwardly therefrom against an inner face of said glue panel;

(ii) a second section having a side edge foldably joined to another side edge of said first section, being secured to said one minor side wall panel, and having an upper edge foldably joined to a lower edge of said pour spout central panel;

(g) said pour spout central panel being secured to an inner face of said dispensing opening cover panel, so when said cover panel is partially detached from said one minor side wall panel at said weakened lines of tear and pulled outwardly therefrom, said central panel will be detached from said upper connecting element third section and will also be pulled outwardly until said pour spout hooks engage said connecting member third section to prevent said pour spout from being pulled completely out of said carton.

2. A carton according to claim 1, wherein said dispensing opening and said cover panel have opposing upper edges that are parallel to each other.

3. A carton according to claim 1, wherein said connecting member upper element second section lower edge is detachably joined to an upper edge of said pour spout central panel by an uninterrupted, arcuate, weakened line of tear.

4. A carton according to claim 1, wherein said connecting member upper element second section lower edge is detachably joined to an upper edge of said pour spout central panel by a line of weakness interrupted by a recess in said second section lower edge.

5. A carton according to claim 1, wherein said dispensing opening and said cover panel have opposed upper edges that are concave in contour.

6. A dispensing carton with an integral pour spout, said carton being formed from a unitary blank of foldable sheet material, such as paperboard, and comprising:

(a) a first major side wall panel, a first minor side wall panel, a second major side wall panel, a second minor side wall panel, and a glue panel foldably joined to each other along parallel fold lines to form a tubular structure open at each end;

(b) pairs of major and minor upper and lower closure flaps foldably joined to upper and lower end edges of said major and minor side wall panels, respectively, and secured to each other in overlapped relation, with said minor upper closure flaps interposed between said major closure flaps, to close said carton ends;

(c) one of said minor side wall panels located adjacent said glue panel and having formed in an upper area thereof, but spaced below an upper edge thereof, a dispensing opening, a major portion of which is covered by a cover panel that is formed from material of said one minor side wall panel, that has a lower edge foldably joined to said one minor side wall panel along a fold line, that has opposed side edges detachably joined to said one minor side wall panel by a pair of weakened lines of tear extending upwardly from opposite ends of said fold line, and that has a free upper edge spaced downwardly from an upper edge of said dispensing opening;

(d) a pour spout including a central panel and a pair of side panels foldably joined to opposite side edges of said side central panel and having hooks at outer ends thereof;

(e) a connecting member upper element having a side edge foldably joined to a free side edge of said glue panel, having a lower portion Covering a minor portion of said dispensing opening, and having a lower edge detachably joined to an upper edge of said pour spout central panel;

(f) a connecting member lower element having a side edge foldably joined to a free side edge of said glue panel, being secured to said one minor side wall panel, and having an upper edge foldably joined to a lower edge of said pour spout central panel;

(g) said pour spout central panel being secured to an inner face of said dispensing opening cover panel, so when said cover panel is partially detached from said one minor side wall panel at said weakened lines of tear and pulled outwardly therefrom, said central panel will be detached from said lower connecting element third section and will also be pulled outwardly until said pour spout hooks engage said connecting member third section to prevent said pour spout from being pulled completely out of said carton.

7. A carton according to claim 6, wherein said connecting member upper element includes:

(a) a first section having an inner side edge foldably joined to a free side edge of said glue panel, lying against said glue panel, and extending toward said one minor side wall panel;

(b) a second section having a side edge foldably joined to another side edge of said first section, being secured to said one minor side wall panel, having a lower portion covering a minor portion of said opening, and having a lower edge detachably joined to an upper edge of said pour spout central panel;

(c) a third section having an upper edge foldably joined to an upper edge of said second section, being folded downwardly over and adhesively secured to said second section, and having a lower portion extending downwardly over an upper portion of said cover panel.

8. A carton according to claim 6, wherein said connecting member lower element includes:

(a) a first section having an inner side edge foldably joined to a free side edge of said glue panel and extending outwardly therefrom against an inner face of said glue panel;

(b) a second section having a side edge foldably joined to another side edge of said first section, being secured to said one minor side wall panel, and having an upper edge foldably joined to a lower edge of said pour spout central panel.

9. A carton according to claim 6, wherein said dispensing opening and said cover panel have opposing upper edges that are parallel to each other.

10. A carton according to claim 6, wherein said connecting member upper element lower edge is detachably joined to an upper edge of said pour spout central panel by an uninterrupted, arcuate, weakened line of tear.

11. A carton according to claim 6, wherein said connecting member upper element lower edge is detachably joined to an upper edge of said pour spout central panel by a line of weakness interrupted by a recess in said second section lower edge.

12. A carton according to claim 6, wherein said dispensing opening and said cover panel have opposed upper edges that are concave in contour.

13. A carton according to claim 6, wherein said cover panel side edge weakened lines of tear are parallel to each other.

14. A carton according to claim 6, wherein said cover panel side edge weakened lines of tear diverge upwardly.

15. A carton according to claim 6, wherein certain said cover panel side edge weakened lines of tear are bowed outwardly relative to other of said weakened lines of tear.

16. A unitary blank of foldable sheet material, such as paperboard, for use in forming a dispensing carton with an integral pour spout, said blank being cut and scored to provide:

(a) a first major side wall panel, a first minor side wall panel, a second major side wall panel, a second minor side wall panel, and a glue panel foldably joined to each other along parallel fold lines;

(b) pairs of major and minor upper and lower closure flaps foldably joined to upper and lower end edges of said major and minor side wall panels, respectively;

(c) one of said minor side wall panels being located adjacent said glue panel and having formed in an upper area thereof, but spaced below an upper edge thereof, a dispensing opening, a major portion of which is covered by a cover panel that is formed from material of said one minor side wall panel, that has a lower edge foldably joined to said one minor side wall panel along a fold line, that has opposed side edges detachably joined to said one minor side wall panel by a pair of parallel weakened lines of tear extending from opposite ends of said fold line, and that has a free upper edge spaced from an upper edge of said dispensing opening;

(d) a pour spout including a central panel and a pair of side panels foldably joined to opposite side edges of said side central panel and having hooks at outer ends thereof;

(e) a connecting member upper element including:

(i) a first section having an inner side edge foldably joined to a free side edge of said glue panel;

(ii) a second section having one side edge foldably joined to an adjacent side edge of said first section, and having another edge detachably joined to an adjacent edge of said pour spout central panel;

(iii) a third section having one edge foldably joined to an upper edge of said second section, being adapted to be folded downwardly over and adhesively secured to said second section, when said carton is erected, with a lower end portion adapted to extend over an upper end portion of said cover panel;

(f) a connecting member lower element including:

(i) a first section having a side edge foldably joined to a free side edge of said glue panel;

(ii) a second section having one side edge foldably joined to an adjacent side edge of said first section, and having another edge foldably joined to an adjacent edge of said pour spout central panel.

17. A carton blank according to claim 16, wherein said dispensing opening and said cover panel have opposing edges that are parallel to each other.

18. A carton blank according to claim 16, wherein said connecting member upper element second section lower edge is detachably joined to an upper edge of said pour spout central panel by an uninterrupted, arcuate, weakened line of tear.

19. A carton blank according to claim 16, wherein said connecting member upper element second section lower edge is detachably joined to an upper edge of said pour spout central panel by a line of weakness interrupted by a recess in said second section lower edge.

20. A carton blank according to claim 16, wherein said dispensing opening and said cover panel have opposed edges that are concave in contour.

* * * * *